US006980880B1

(12) United States Patent
Ramsey

(10) Patent No.: US 6,980,880 B1
(45) Date of Patent: Dec. 27, 2005

(54) CONDUIT BENDING SYSTEM

(75) Inventor: Robert J. Ramsey, Cincinnati, OH (US)

(73) Assignee: Janet Ramsey, Cincinnati, OH (US)

( * ) Notice: Subject to any disclaimer, the term of this patent is extended or adjusted under 35 U.S.C. 154(b) by 32 days.

(21) Appl. No.: 10/684,736

(22) Filed: Oct. 14, 2003

(51) Int. Cl.[7] ..... G06F 19/00
(52) U.S. Cl. ..... 700/165; 72/31.04
(58) Field of Search ..... 72/31.04, 31.05, 72/31.08, 31.1; 700/165

(56) References Cited

U.S. PATENT DOCUMENTS 4,080,814 A * 3/1978 Eaton ..... 72/31.04
4,161,110 A * 7/1979 Ritter et al. ..... 72/16.6
4,551,810 A * 11/1985 Levine ..... 700/182
4,719,577 A * 1/1988 Eley ..... 700/165
5,315,522 A * 5/1994 Kauffman et al. ..... 700/165
6,253,595 B1 * 7/2001 Lewis, Jr. ..... 72/369
2003/0069662 A1 * 4/2003 Chebbi ..... 700/165

* cited by examiner

*Primary Examiner*—Leo Picard
*Assistant Examiner*—Alexander Kosowski
(74) *Attorney, Agent, or Firm*—Wood, Herron & Evans, L.L.P.

(57) ABSTRACT

A bend determining system automatically determines the position of a second bend of an offset based upon input offset and angle specifications. The system automatically repeats the angle of a first bend of the offset at the second bend without requiring an installer to remove the conduit from the bender.

24 Claims, 4 Drawing Sheets

CONDUIT BENDING SYSTEM

FIELD OF THE INVENTION

The present invention relates to the preparation and installation of conduit, and more particularly to tools used for bending conduit to create a desired offset.

BACKGROUND OF THE INVENTION

The installation of electrical wires in homes and commercial buildings requires encasing the wire in conduit for safety, aesthetic and structural considerations. Conduit is sold commercially in straight pieces of varying length and material. In many applications, an installer must bend conduit to accommodate a physical structure in the routed path of the conduit. For instance, conduit is routinely bent to avoid a beam, pillar or other obstruction in a building.

In such a circumstance, the installer typically creates an offset in the conduit. That is, the installer bends the conduit in a first direction to go around the obstruction, and after extending a short distance, bends the conduit in a second, but opposite direction. In this way, the conduit continues in a direction substantially parallel to its original course, but offset in order to avoid the obstruction. After passing the obstruction, the craftsman installing the conduit may bend the conduit a third and fourth time in opposite directions so that the conduit resumes its initial path.

Bending an offset into conduit is a labor intensive job that conventionally requires a great deal of time, knowledge and experience. A single offset generally takes two installers the better part of a hour to create on conduit trade sizes over two inches. Even the most skilled installers will routinely misjudge where an offset bend should be placed, resulting in the bend being re-accomplished and/or the conduit being discarded. In fact, the industry generally budgets for and tolerates about ten percent wastage with regard to conduit. That is, one out of every ten feet of purchased conduit will typically be rendered unusable by the end of an installation job. Because of costs associated with these labor and material requirements, the installation of conduit accounts for a significant portion of a construction budget.

To mitigate these costs, manual, electric, hydraulic and other mechanical conduit benders have been developed to assist installers in making offsets. A typical hand bending machine may include a handle screwed into a body having an arcuate shoe at the bottom with a groove to accommodate the conduit. The body may also have a hook which hooks around the conduit in the groove. The installer may bend the conduit by exerting a force on the handle to roll the shoe along the conduit and achieve a bend. Machine benders generally rely on the same principles, however, include hydraulics or other sources to power a ram that exerts power on a shoe to bend the conduit.

These benders, however, do not meaningfully assist an installer in deciding where bends should be made in a conduit to create a desired offset. Despite the criticality of bend placement, an installer is relegated to estimating, or eyeballing, where such bends should be made along the length of the conduit. This industry practice of eyeballing often degenerates into unreliable trial and error even for the most skilled installers. Imperfect offsets translate into the installer having to scrap the conduit piece, or where possible, re-accomplish the bend. Either scenario translates into undesirable waste and expense.

Moreover, conventional practices require that the conduit be disengaged from the bending tool in order to determine the position of a subsequent bend. This is required, in part, because the installer must eyeball angles to determine the next bend point. Taking the conduit in and out of the bending machine requires at least two installers and represents a significant labor inefficiency.

Job manuals and training provide little practical remedy for inefficiencies associated with determining an offset bend. While some manuals provide estimated distance dimensions, the limited number of bend angles associated with these estimates limits their practical utility. For example, conventional bending manuals do not address, and thus, discourage the use of bend angles that deviate from standard 15°, 30° or 45° angle bends. As can be appreciated, bends of alternate and varying degrees are desirable given certain practical circumstances of a particular installation. Moreover, it is very difficult to accomplish one of the prescribed bend angles with enough precision to make the manual estimates worthwhile. In any case, most installers are reluctant to use such manuals and associated multipliers because of the time requirements and inherent complexities of such calculations.

Conventional methods also require the installer to take the diameter of the pipe into account when calculating bend centers needed to estimate bend distances. For instance, the conduit diameter may affect where the installer will interpolate the center of a first bend as being. An error in this estimate has a cascading affect on subsequent estimates. This diameter variable thus further complicates field calculations or eyeball estimates, contributing to incorrect offsets and other inefficiencies.

Errors stemming from imperfect bend distancing are compounded where angles of associated offset bends do not match. However, conventional benders generally rely on user judgment to indicate stop points to achieve a desired degree of bend. Some tools have visual markings along the anvil, or ram, side that generally indicate angles of a bend. As above, however, reliance on user judgment or on visual markings offers only a limited accuracy of bend.

For all of these reasons, what is needed is an improved manner for bending conduit.

SUMMARY OF THE INVENTION

The present invention addresses the problems of the prior art by providing a method, apparatus and program product that in part, automatically determines where a second bend of an offset should begin. The determination is automatically made in response to input offset and angle specifications. Where desired, processes consistent with the invention automatically repeat the angle of a first bend in the offset at the second bend without requiring an installer to remove the conduit from the bender. The invention thus mitigates imprecisions associated with conventional estimates.

In use, an installer enters a desired offset and actual bend angle into a bend determining device. Where desired, the bend determining device includes a protractor feature for precisely figuring the actual angle. Where desired, the protractor automatically communicates the actual angle to a processor of the bend determining device for determining the distance value. In any case, the bend determining device automatically processes the offset and angle information to determine a distance value. The distance value is indicative of where a second bend of an offset should occur. In this manner, the invention reduces the need for trial and error and other estimates conventionally associated with determining a distance between offset bends. In so doing, waste and other inefficiencies associated with conventional eyeballing practices are dramatically reduced.

The distance value is communicated to the installer, who then repositions the conduit within and without removal from the bender in such a manner as a second bend of the conduit occurs at an appropriate point. In allowing the conduit to remain in the bender, the invention further reduces labor costs associated with two or more installers having to conventionally remove and replace conduit.

Where advantageous, the angle of the bend may be repeated automatically using a position indicating device. An exemplary position indicating device may comprise a laser device and/or switch positioned along the travel of a bender component. The position indicating device may signal the installer or otherwise halt bending in response to detecting that a desired bend angle or component travel has been achieved. User error is thus further minimized. Moreover, the installer is not limited to a finite number of bend angles that may be used in order to accomplish a successful offset. The processes of the present invention further apply irrespective of conduit material, diameter and bend angle. Efficiencies associated with these features translate into dramatically reduced labor costs.

For added benefit, some embodiments of the present invention do not require the purchase of new equipment, in that the present invention complements and augments existing benders. Where advantageous, an apparatus that is consistent with the principles of the present invention may be readily carried and reused from one job to another. As such, improvements associated with this invention increase the utility and application of conventional benders. In any case, processes of the present invention translate into increased efficiency and decreased waste.

These and other features and benefits of the invention will be more readily understood in view of the following detailed description and the drawings.

BRIEF DESCRIPTION OF THE DRAWINGS

The accompanying drawings, which are incorporated in, and constitute a part of, this specification, illustrate embodiments of the invention and, together with the general description of the invention given above, and the detailed description of versions of the invention given below, serve to explain the principles of the invention.

DETAILED DESCRIPTION OF VERSIONS OF THE INVENTION

Figure 1:
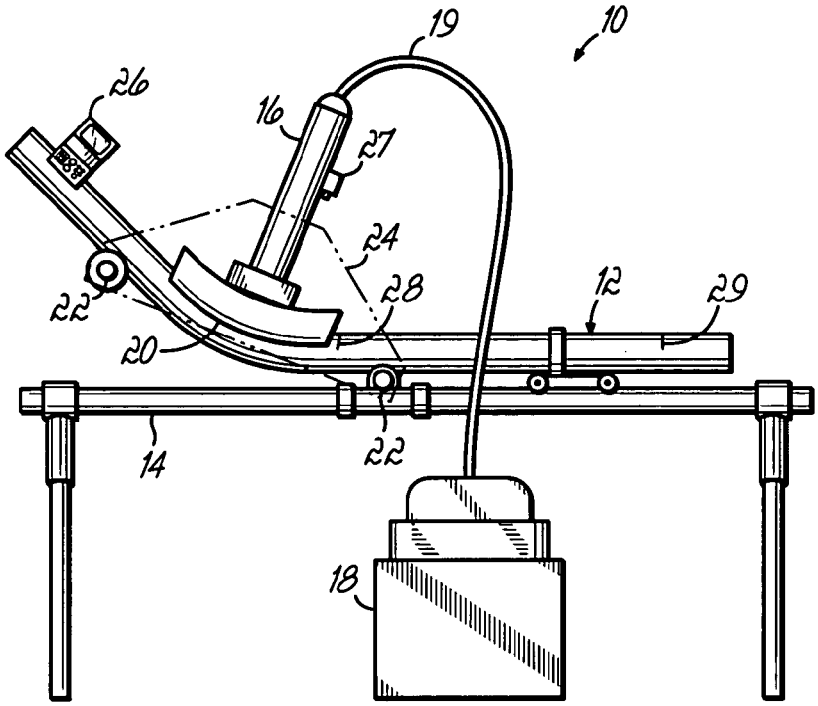
FIG. 1 is a schematic drawing of a bending system in accordance with a preferred embodiment of the present invention.

FIG. 1 is a schematic drawing of a conduit bending system 10 in accordance with the principles of the present invention. The system 10 is, in part, configured to automatically determine the position of an offset bend in a conduit piece 12. For example, the system 10 may determine a desired distance between bends of an offset. The system 10 shown in FIG. 1 also automatically detects and/or repeats an angle of a previous bend of an offset.

Turning more particularly to FIG. 1, the conduit piece 12 is positioned on a bending table 14 of an exemplary hydraulic bending machine. A ram 16 is supplied power by a hydraulic pump 18 via a hose 19. A ram 16 comprises a bender component that communicates force to a shoe 20. A typical shoe 20 includes a groove to accommodate the conduit piece 12. A hook, or other support device 22, generally opposes force communicated by the ram 16 and shoe 20 onto the conduit 12 such that a bend is accomplished between the supports 22. A bender frame 24 holds the supports 22 in fixed relation to each other.

The bending system 10 also includes a bend determining device 26 for automatically determining a position 29 indicative of where the second bend of an offset should be accomplished. This position 29 may be output to the installer in terms of a first bend position. As shown in FIG. 1 for exemplary purposes, a mark 28 is shown on an already bent conduit piece 12 at a position where the first bend was initiated at the shoe 20. In any case, the bend determination device 26 may conjunctively process input offset and angle data for purposes of making the automatic determination.

The system 10 also includes a position indicating device 27, which is shown in FIG. 1 as being attached to the ram 16. A suitable position indicator device 27 is configured to detect and/or stop ram travel when a desired ram position or bend angle is achieved.

One skilled in the art will appreciate that while the hydraulic bending machine of FIG. 1 may have particular application in certain embodiments, the underlying principles of the present invention apply equally to all machine and manual bending devices. That is, the present invention is compatible with and improves any bending system having a mechanism for bending a conduit piece at a generally intended position.

Figure 2:
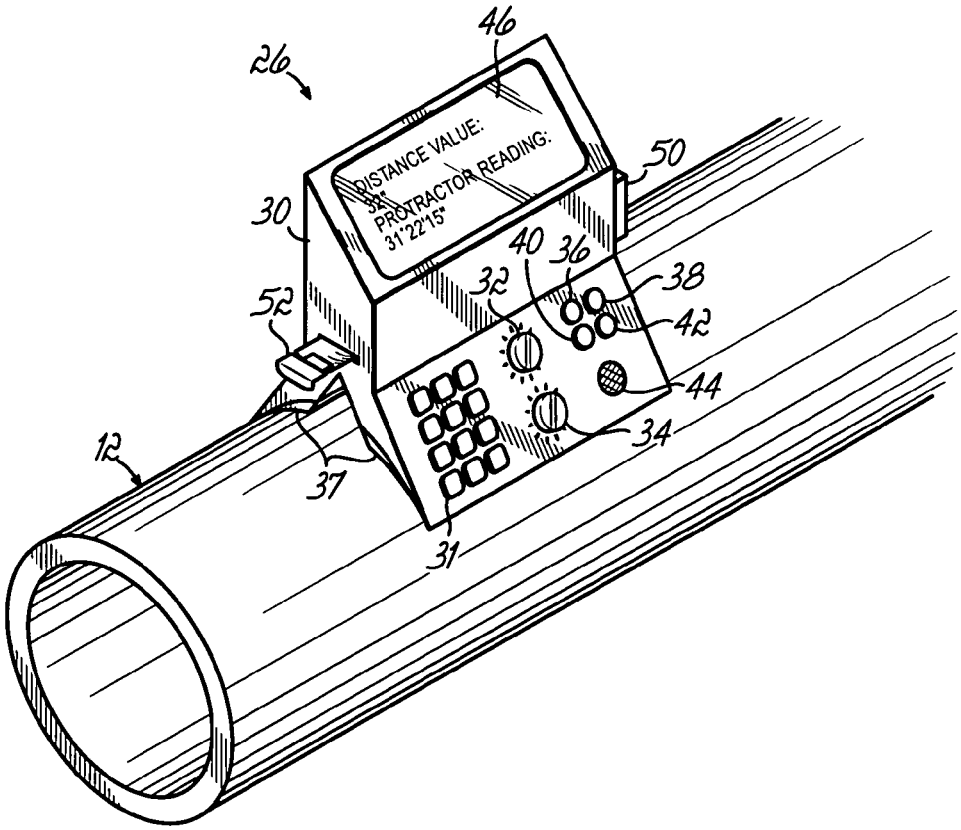
FIG. 2 is a schematic that shows the bend determining device of FIG. 1 in greater detail.

FIG. 2 shows the bend determining device 26 of FIG. 1 in greater detail. For instance, FIG. 2 shows the frame 30 of the bend determining device 26 as attached to the conduit piece 12. The frame 30 shown in FIG. 2 attaches via a magnet 37. One skilled in the art, however, will appreciate that other attaching mechanisms, including clamps, tape, hooks, arm structure and Velcro®, among others, may alternatively be used to attach the bend determining device 26 to the conduit 12 or bender. Moreover, the exemplary bend determining device 26 may attach to any part of the bending system 10, or may be held in the hand, pocket, belt or other carrier of an installer. To this end, the height, width and length dimensions of the bend determining device 26 are typically all under eight inches.

The bend determining device 26 of FIG. 2 supports mechanisms 31–44 for receiving user input. For example, the embodiment of FIG. 2 includes a numeric keypad 31, dials 32 and 34, an automatic determination button 36, a store/recall button 38, a true zero button 40, a false zero button 42 and a microphone/speaker 44. The numeric keypad 31 may include standard calculator functions, and the microphone/speaker may enable audible signals to be communicated to the installer. For instance, the speaker 44 may make an audible tone when the device 26 is oriented at a 0° or 90° angle. Where the bend determining device 26 supports voice recognition software, the microphone/speaker 44 will allow voice commands of the installer to be recognized and input into the processes of the bend determining device 26. One skilled in the art will appreciate that other input devices may be included within a bend determining device 26 that is consistent with the principles of the present invention, to include a port for communication with a remote source.

The bend determinating device 26 also includes a display 46 for communicating information to the installer. For example, a suitable display may comprise a liquid crystal display (LCD).

The frame 30 may include a clip 50 for a level or other orienting device, such as a No Dog® or a mechanical angle. Another attachment or integral feature may include a measuring device, such as a retractable ruler 52. Where advantageous, the bend determining device 26 may include an accelerometer or other internal device useful for measuring a distance moved by the actual bend determining device 26. An exemplary accelerometer comprises a device configured to generate an electronic output in response to movement. As such, program code of the present invention may process such output to arrive at a relative distance measurement traveled by the bend determining device 26 as an installer moves the device 26 along the conduit 12, for example. The bend indicating device 26 may additionally include a digital or mechanical protractor for measuring bend angles. One skilled in the art will appreciate that other features may be included within the frame 30 for the convenience of the installer, including a pen or a chalk holder.

While the bend determining device 26 is separate from the position indicating device 27 in the exemplary system 10 of FIG. 1, the bend determining device 26 of another embodiment that is consistent with the principles of the present invention may also include the hardware and functionality of the position indicating device 27. Moreover, either or both the bend determining and position indicating devices 26 and 27, respectively, may be integral with the bender.

Figure 3:
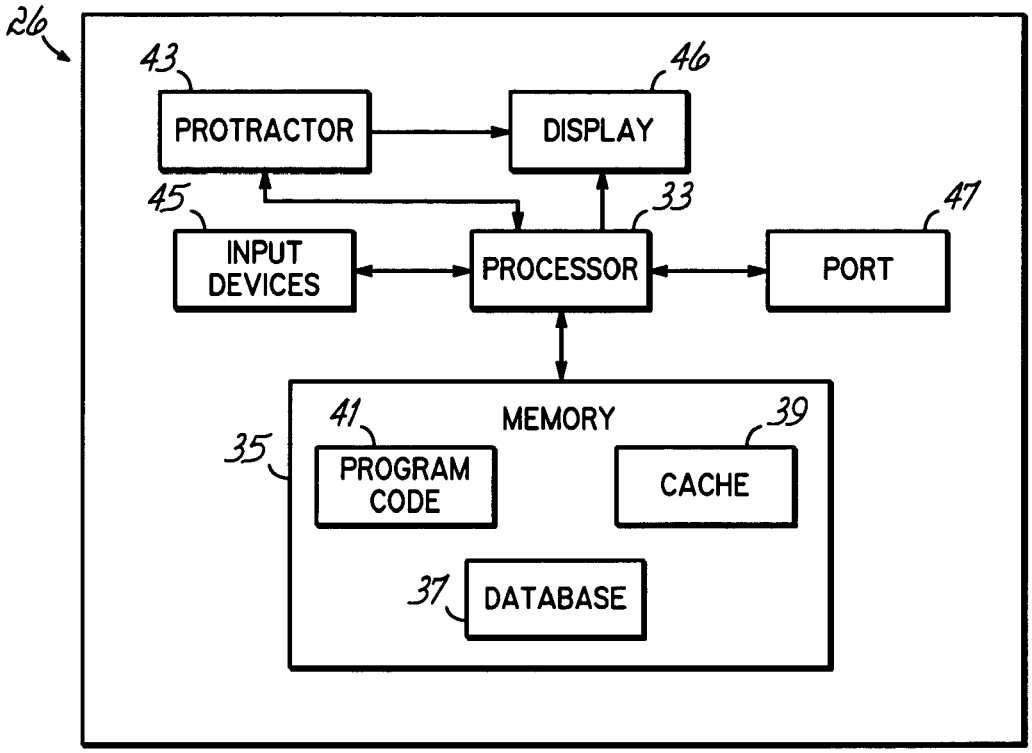
FIG. 3 is a block diagram of the bend determining device of FIGS. 1 and 2.

FIG. 3 is a block diagram of the bend determining device 26 of FIGS. 1 and 2. As shown in FIG. 3, the bend determining device 26 includes one or more processors 33. The bend determining device 26 may additionally include a memory 35 accessible to the processor 33. The memory 35 may include a database 37 and/or cache memory 39. For instance, a database may contain lookup values for converting decimal measurements to their English equivalents. A different database may contain distance values correlated to actual angle and offset values. As such, an embodiment of the present invention may determine a distance value by associating an angle and offset that are logically linked to the distance value. Cache memory 39 may be used to temporarily store a determined actual angle prior to processing, for instance.

The bend determining device 26 may further include program code 41. Program code 41 typically comprises one or more instructions that are resident at various time in memory 35, and that, when read and executed by the processor 33, cause the bend determining device 26 to perform the steps necessary to execute steps or elements embodying the various aspects of the invention.

As shown in FIG. 3, the processor 33 of the bend determining device 26 additionally communicates with a protractor 43 for measuring bend angles. In one embodiment, the protractor 43 automatically communicates an actual bend angle to the processor 33 for determining the distance value. A false zero mode feature of another or the same embodiment allows the protractor to determine the actual angle of a bend where the conduit 12 is not level.

The processor also receives and outputs data via various input devices 45, display 46 and port 47. As such, the bend determining device 26 of an embodiments that is consistent with the principles of the present invention may communicate with and access remote processors and memory, among other remote resources.

Figure 4:
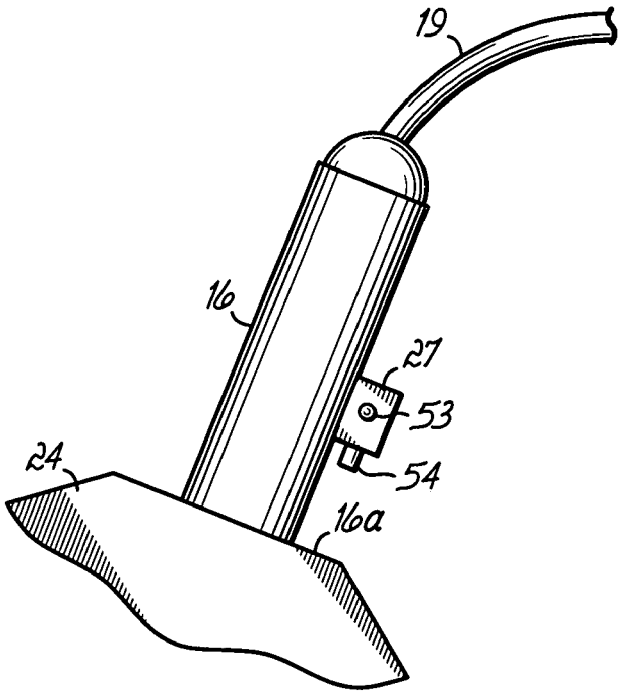
FIG. 4 is a schematic that shows the position indicating device of FIG. 1 in greater detail.

FIG. 4 shows the exemplary position indicator device 27 of FIG. 1 in greater detail. As shown in FIG. 4, the position indicator device 27 includes a light emitting diode (LED) 53 for indicating when the ram 16 has traveled a desired distance. One skilled in the art will appreciate that other embodiments of the position indicating device that are consistent with the principles of the present invention may include a speaker, an antenna, port or any mechanism useful in signaling an installer or otherwise affecting a bend operation.

The exemplary position indicating device 27 also includes a switch 54, which contacts a stationary surface **16*a* and illuminates the LED 53. As described below in greater detail, the installer may set the position of the position indicating device 27 along the ram 16 or other appropriate system 10 component to indicate when a desired bend angle has been achieved and/or repeated. For instance, the position indicating device 27 shown in FIG. 4 remains attached to the ram 16 as it travels towards the conduit piece 12 during a bending operation. As such, an installer may make a first bend to a desired degree, then attach the position indicating device 27 to the ram 16 before the ram 16 is returned from its furthest point of travel. More particularly, the position indicating device 27 is attached to the ram 16 at the completion of the first bend such that the switch 54 will be activated by the surface 16*a*** on a subsequent bend.

In one embodiment that is consistent with the principles of the present invention, the position indicating device 27 acts as a stop-switch that automatically halts the bender when a desired distance and/or angle is detected. As with the bend determining device 26, the position indicating device 27 may attach to or be integral with any component of the bending system 10 as appropriate.

One skilled in the art will appreciate that while a switch 54 may have particular application in some embodiments, laser-finding, electromagnetic wave and other position detecting technologies may alternatively be included in a suitable position indicating device 27. In any case, this position indicating device 27 feature of the present invention mitigates the criticality of achieving an intended bend angle by allowing the actual angle to be precisely repeated.

Figure 5:
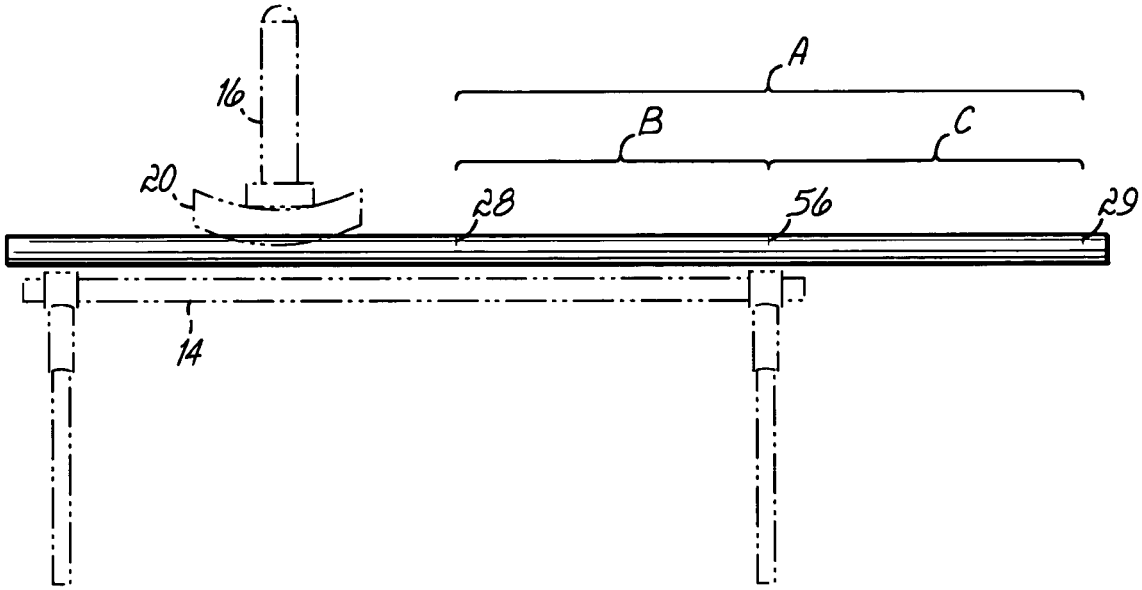
FIG. 5 is a schematic of a conduit piece suitable for bending in accordance with the principles of the present invention.

FIG. 5 shows an exemplary conduit piece 12 suited for showing bend positions 28, 29 and 56 in accordance with the principles of the present invention. A bend position for purposes of this specification may include a position along a length of the conduit piece 12 that is indicative a point along the conduit 12 where a bend should be. A first bend position 28 corresponds to a position 28 along the conduit 12 just below an edge of the shoe 20. As such, position 28 may or may not coincide with the center of an associated bend, depending on the bender and installer preference, for instance. A point along the conduit 12 other than the center of the bend may comprise a conventional start point that an installer uses as a reference for lining up a first bend in a conduit 12 in relation to the shoe 20. As such, it only matters that the installer use the same identifiable start position with regard to subsequent bends, as any deviation from the center of a bend is carried over to the second bend 56 in application.

In any case, the installer aligns the first bend position 28 with the shoe 20 or other bending machine component as is conventionally accomplished by sliding the conduit 12 along a table 14 and/or the bender. In certain embodiments that are consistent with the principles of the present invention, the installer may make a mark with pen or chalk at the first bend position 28. Another mark may be made at a reference position 29. The reference position 29 may be chosen arbitrarily and/or be based on installer judgement. While described below in great detail, a reference position 29 may be used where it assists the installer in locating the second bend position 56.

As shown in FIG. 5, the distance between the first bend point 28 and the reference position 29 is distance "A." The mark 56 along the conduit 12 represents the position of a second bend position. This second bend position 56 is determined using the bend determining device 26. For instance, the bend determining device 26 may output on its display 46 a distance value corresponding to the distance between the first bend position 28 and the second bend position 56. This distance value is shown in FIG. 5 as "B."

One benefit of an embodiment of the present invention is that both bends of an offset may be accomplished without requiring removal of the conduit from a bending machine. While this feature greatly reduces labor requirements, it may, under some circumstances, complicate direct measurement of the distance value to the second bend position 56 from first bend position 28. For instance, the first bend position 28 may no longer be in the same plane as the second bend position 56 because the installer has already bent the conduit 12. That is, it may be advantageous for the installer to make the first bend of an offset (using the first bend position 28) prior to determining the second bend position 56. This may the case where the exact angle of the first bend is and/or cannot be known prior to the bending operation. For example, limitations of the bending machine may not allow an intended bend angle to be precisely accomplished during bending. That is, an installer attempting a 20° bend may actually bend the conduit on 19.5°. As such, installer will wish to use the actual, 19.5° angle as input when determining the position 56 of the second bend.

Under such circumstances, the reference position 29 can be used to locate the second bend position 56 in an instance where it is not convenient or possible to measure from the first bend position 28. For example, the second bend position 56 may be located by subtracting the output distance value B from the known distance value A to arrive at distance value C. The installer may then measure back from the reference position 29 towards the shoe 20 the distance C to locate and mark the second bend position 56. For instance, where A is 4 feet and B is 2 feet and 5 inches, a mark will be placed at the second bend position 56 at a point 1 foot and 7 inches away from the reference position 29 along the length of the conduit 12 and towards the first bend position 28.

Once accordingly marked, the installer may slide, turn over, and/or otherwise reposition the conduit 12 such that the second bend position 56 is properly oriented to the shoe 20 in the same fashion as was the first bend point 27 during the prior bend.

Where the installer has alternatively chosen the reference position 29 to be of a shorter distance from the first bend position 28 than the distance value, than the second bend position 56 may be alternatively determined by measuring a distance from the reference position 29 in the direction away from the first bend point 28 that is equivalent to the difference between the distance value and the reference position 29.

As discussed herein, the installer may reposition the conduit 12 while the conduit 12 remains in the bender. This feature saves time over conventional systems, which require one or more installers to remove the conduit from the bender in order to determine a comparable (though less accurate) starting point for a second bend. As discussed herein, accuracies associated with the bend determining device 26, and more particularly, the determined distance value, further remove guesswork associated with eyeballing and estimating the location for the second bend position.

Moreover, the exemplary positions 28, 29 and 56 of FIG. 5 may be made on conduit of any size and material without impacting the principles of the present invention. This feature broadens the application of the present invention and simplifies bending operations for installers who have previously had to account for conduit diameter when determining a bend center, for instance.

One skilled in the art will appreciate that where a bending machine is capable of accurately and repeatably bending the conduit to a desired degree, it is possible to determine the second bend position 56 prior to making the first bend at position 28. Such an embodiment may altogether eliminate the need for a reference position 29.

Figure 6:
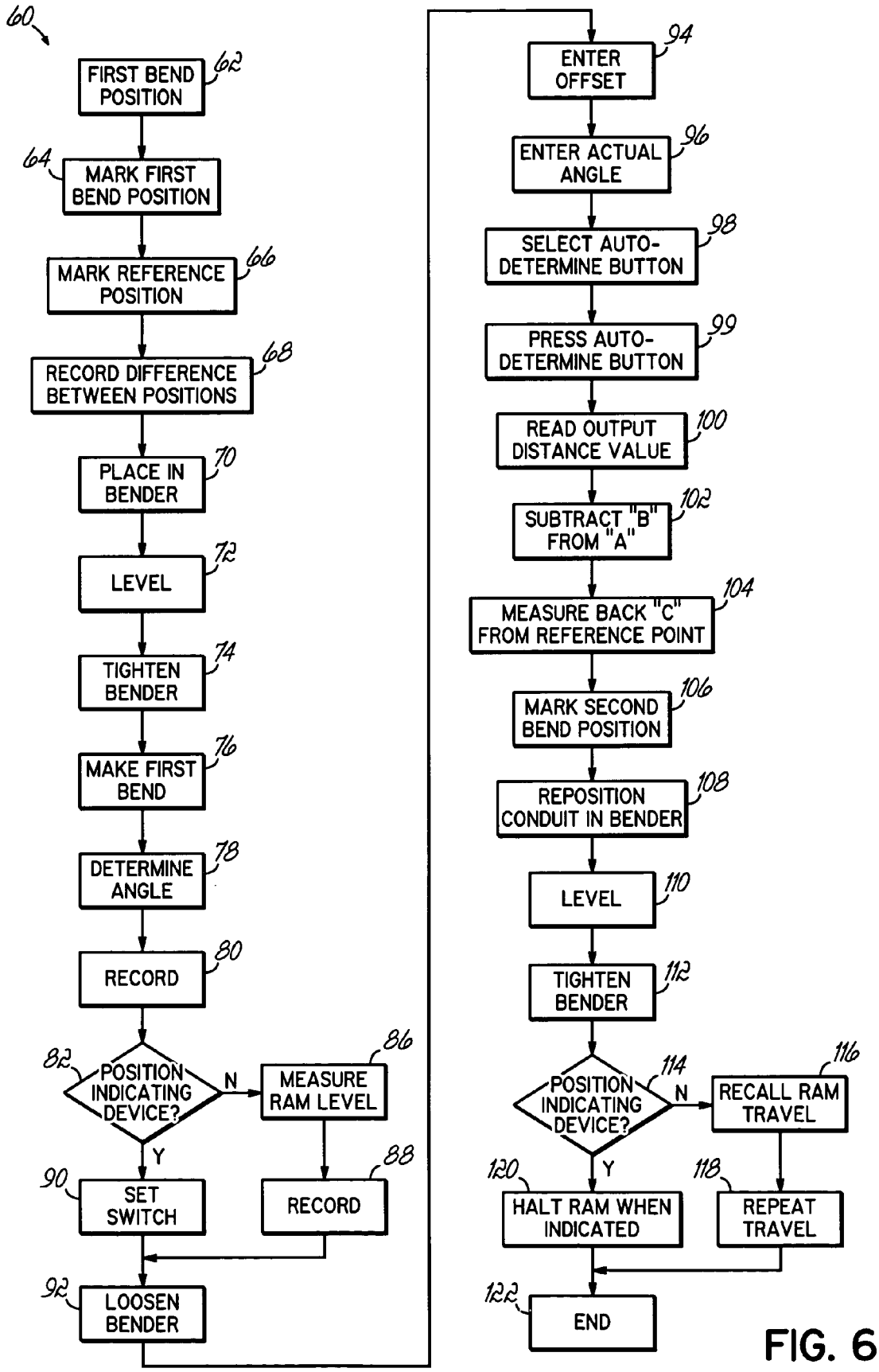
FIG. 6 is a flowchart that shows a sequence of steps for bending conduit in accordance with the principles of the present invention.

FIG. 6 shows a sequence of exemplary steps taken by an installer using the bending system 10 of FIG. 1 to create an offset in accordance with the principles of the present invention. The term "offset" for purposes of this specification may include any application where more than one bend is made in a conduit piece. As shown in block 62 of the flowchart 60 of FIG. 6, an installer may locate a first bend position 28 along the length of a conduit 12. The first bend position 28 may coincide or otherwise align with a part of a bender as is conventionally known. The installer may then mark the first bend position 28, and where desired, a reference position 29 as shown at blocks 64 and 66, respectively.

As discussed in connection with FIG. 5, a reference position 29 may be useful where an installer intends to make the first bend prior to determining the second bend position. For instance, the installer may wish to make the first bend in order to ascertain the exact angle of the first bend for use in later repeating that exact bend angle with regard to the second bend position 56. In such a case, the difference between the first bend and reference position is recorded on paper or within memory of the bend determining device 26. For instance, the installer may use a numeric keypad 31 or dial 34 to enter in the measured distance, A.

Although one of skill in the art will appreciate that the above steps may be accomplished while the conduit 12 is in the bending machine or tool, the installer in the embodiment of FIG. 6 places the marked conduit 12 in the bender at block 70. Placing the conduit 12 may include initially aligning the first bend position 28 with the bender in anticipation of making the first bend. The installer attaches a level to ensure proper orientation of the conduit 12 during the bending operation as shown at block 72. The bender is tightened at block 74 in preparation of bending at block 76.

At block 75, the installer may attach the bend determining device 26 to the conduit 12. The installer may use a protractor component 43 of the bend determining device 26 to determine the actual angle of the ensuing bend. In one embodiment that is consistent with the principles of the present invention, the bend angle read by the bend determining device 26 is automatically stored for later, automatic recall when determining the distance value. Alternatively, the installer may write down or otherwise record the actual angle, as measured with the bend determining device 26 and/or some angle measurement mechanism associated with the bender when making this first bend.

Once the first bend is accomplished at block 76, the installer may determine the exact angle of the bend at block 78. For instance, the installer may use a protractor feature of the bend determining device 26. This is possible even where an installer has not taken the time to precisely level the conduit in the bender for the first bend. The false zero button 42 of the bend determining device 26 allows exact bend angle measurements irrespective of whether the conduit 12 is precisely level. This feature saves time that would otherwise be spent leveling the conduit 12. This feature further increases angle measurement accuracy by obviating measurement error conventionally attributable to the conduit being imprecisely leveled.

In practice, the installer may select the false zero button 42 of the bend determining device 26 while the device 26 is oriented along the length of the bent or unbent portion of the conduit 12. Selection of false zero 42 internally scales output of a protractor reading from the bend determining device 26 such that the protractor output accounts for any degree deviation that the conduit 12 is from true level. For instance, if the conduit 12 is actually at an angle of 3° 20' off of level, any subsequent readings made in false zero mode while using the bend determining device 26 will be scaled according to the 3° 20' measurement.

Continuing with the above example, should the installer place the bend determining device 26 along the bent portion of the conduit 12 in order to determine its angle relative to the false zero point, and while operating in false zero mode, the bend determining device 26 may internally register a false zero angle of 34°. As such, the processor of the bend determining device 26 will adjust the false zero measurement according to the false zero measurement of the non-bent portion of the conduit 12 to determine the actual angle. Namely, 3° 20' is subtracted from 34° to arrive at an actual angle of 31° 40'. This actual angle may be output to the installer via the display 46 of the bend determining device 26 at block 78 of FIG. 6. Where desired, the actual angle may be recorded by the bend determining device 26 or by some other mechanism at block 80.

Where the installer has alternatively taken the time to level the conduit 12 when initially placing it in the bender, the automatic determining device 26 may operate as a normal protractor in true zero mode when determining the actual angle.

How an installer repeats the actual angle may depend in part upon whether a position indicator device 27 is available as shown at block 82. Where no such position indicator device 27 is used at block 86, the installer may measure and record the movement of a ram 16 or other bender component. For instance, a ram 16 may include hash marks useful in judging ram travel. As is known by those skilled in the art, such ram travel roughly correlates to the angle at which the conduit 12 is bent. Recording the ram travel at block 88 may be accomplished using the bend determining device 26 and be useful for repeating the first bend.

Alternatively using a position indicating device 27 may function to streamline and improve the accuracy of conventional processes used to repeat a desired bend. For instance, an installer may merely have to attach the position indicator device 27 to a ram or other moving component of a bender such that a switch 54 or other trigger mechanism will be actuated or otherwise initiated when the ram 16 brings the position indicator device 27 to a ram position corresponding to a desired degree of bend. Once this switch or laser-finder is set at block 90, subsequent bends can be automatically monitored and aligned with the previous bend. For example, an audible signal or LED 53 may initiate to apprise the installer that repeated ram travel has occurred. Use of the position indicator device indicator 27 thus obviates the requirement of recording ram travel by the installer.

The installer may then loosen the conduit piece 12 while still within the bender at block 92. Loosening the conduit 12 will allow the installer to slide or otherwise reposition the conduit 12 according to an automatically determined second bend point 56.

To this end, the installer may enter the desired offset into the bend determining device 26. For instance, the installer may type or speak "three feet" at block 94. The installer may additionally enter the actual angle of the bend at block 96 as determined at block 78 of FIG. 6. As discussed herein, the actual angle may alternatively be automatically recalled by the bend determining device 26 without requiring action by the installer. In either case, the installer may then press the automatic determination button 36 at block 99 to receive an output distance value at block 100.

At block 102, the installer may subtract the output distance value from the distance comprising the span between the first bend and the reference positions 28 and 29, respectively, as recorded at block 68 of FIG. 6. Where advantageous, this measurement may be recalled using a button 38 of the bend determining device 26. This subtraction may be facilitated by the processor and numeric pad 31 of the bend determining device 26. Any necessary conversions from decimal outputs to English measurements may be automatically accomplished using a dial 32 and/or conversion table of the bend indicating device 27. In one embodiment, the distance value is converted to English units prior to being displayed to the installer. While the data contained in such a table may be included within the memory of the bend determining device 26, it may alternatively be included on a sticker that attaches to the device 26 for the convenience of the installer.

The installer may then measure back from the reference position 29 a distance C corresponding to the difference between B and A. The installer may then mark and/or reposition the conduit piece 12 within the bender such that a second bend will commence at the second bend position 56.

Prior to making the second bend, the installer may orient or otherwise level and tighten the conduit piece 12 within the bender at blocks 110 and 112, respectively. Where no position indicator 27 has been used during the previous bend, the installer may recall and attempt to repeat the previous ram travel at blocks 116 and 118, respectively. The installer otherwise uses the position indicating device 27 for automatic notification that ram travel has been repeated. Another embodiment that is consistent with the present invention may automatically halt ram travel when a repeat bend has been achieved. In either case, an accurate offset is achieved at block 122 in a fraction of the time it takes conventional bending processes.

Figure 7:
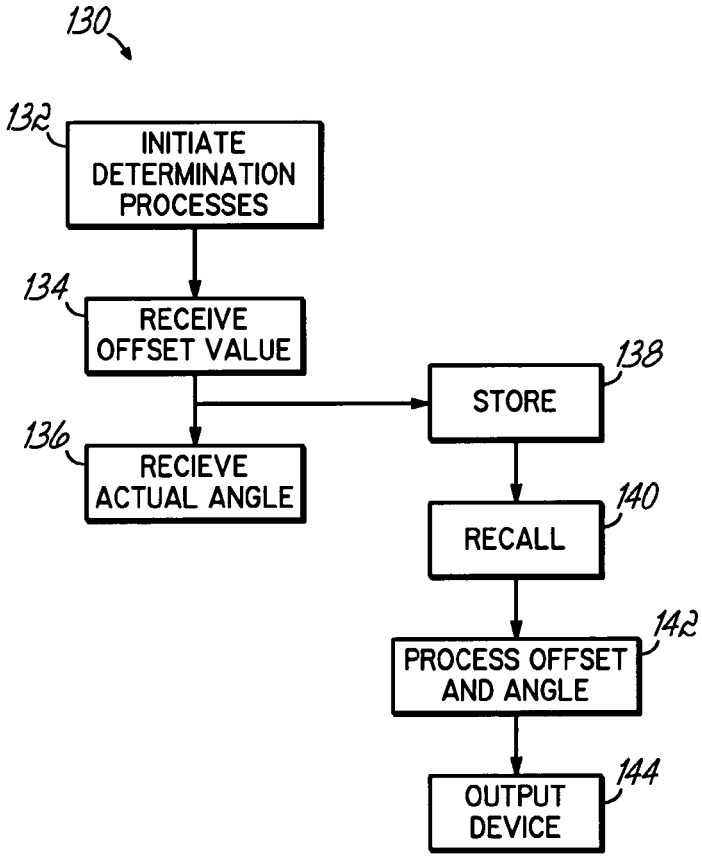
FIG. 7 is a flowchart that shows a sequence of steps executed by the bend determining device of FIGS. 1 and 2 to determine the position of a conduit bend.

The flowchart 130 of FIG. 7 shows a sequence of steps that are executable by the bend determining device 26 of FIGS. 1 and 2. More particularly, the installer may activate the device 26 at block 132. Such initiation processes may include booting up necessary software, notifying the installer of its readiness and prompting the installer for information.

The bend determining device 26 receives the offset value and actual angle at blocks 134 and 136, respectively. These values may be stored and recalled as needed at blocks 138 and 140, respectively. In one embodiment discussed herein, bend determining device 26 automatically receives the actual angle when measuring the first bend angle. Thus, the actual angle may be automatically recalled by the bend determining device 26 without requiring action by the installer at block 140.

Program code of the bend determining device 26 may process the offset and actual angle data at block 142. Such processing may include applying a trigonometric function to either or both the input offset and angle. Trigonometry concerns relations of sides and angles of triangles. For example, the offset may be divided by the sine of the actual angle as shown below:

distance value=desired offset/sine (actual angle).

In use, for instance, an installer may input data indicating an offset of one foot is required. Other input may indicate that the actual angle of the first bend is 31°. In response to this input, the program code may automatically determine a distance value of 23.29 inches. This distance value corresponds to the optimal distance between first and second bends of an offset. As discussed herein, the installer may use the distance value as a measurement between bend starting points relative to the bender where desired, so long as the same alignment practices are used for both bends. In any case, the distance value is output on the display 46 of the bend determining device 26 for the installer at block 144 of FIG. 7.

In yet another example, an installer makes a mark at a first bend position 28, and a second mark at a reference position 29. The reference position 29 is located two feet away along the length of the conduit. The installer makes a first bend in a conduit 12 at the first bend position 28 and at an approximate, desired angle. For instance, the installer may attempt to bend the conduit 12 20°. The installer then determines the actual angle of the bend, for instance, 18.5°. This actual angle of the bend is input into the bend determining device 26 along with a desired offset value. For instance, the installer may be required to make a 10 ⅜ inch offset.

In response to this input, the bend determining device 26 automatically determines a distance value useful in locating where a second bend position 56 should be. For example, the device 26 may output "32.5 inches." The installer may position a ruler such that the 2 two foot mark of the ruler aligns with the reference position 29. The installer may then mark the conduit 12 at a second bend position 56 that coincides with the 32.5 inch mark of the ruler.

The installer then repositions the conduit 12 such that a second bend is initiated at the second bend position 56 without having to remove the conduit 12 from the bender. The angle of the first bend is repeated with regard to the second bend. Where advantageous, a position indicating device 27 automatically informs the installer when the first bend (and actual) angle has been repeated. This feature further removes user error associated with estimating ram travel and bend angle. In this manner, a desired offset is quickly and accurately achieved.

While this application describes one presently preferred embodiment of this invention and several variations of that preferred embodiment, those skilled in the art will readily appreciate that the invention is susceptible to a number of additional structural and programmatic variations from the particular details shown and described herein. For instance, any of the exemplary steps of the above flowcharts may be augmented, replaced, omitted and/or rearranged while still being in accordance with the underlying principles of the present invention.

In another example, the position indicating device 27 may be included within the bend determining device 26. In one such embodiment, the protractor 43 and memory 35 of the bend determining device 26 may be used to automatically record the first bend angle. On a subsequent bend, the bend determining device 26 may be attached to the conduit 12 while being bent. As such, the position indicating device 27 of the bend determining device 26 may automatically signal the installer and/or otherwise halt the bender. Moreover, while embodiments of the present invention have particular application in the context of construction and electrical installation operations, other preferred embodiments may have application within any field requiring the bending of a tube or pipe structure. Therefore, it is to be understood that the invention in its broader aspects is not limited to the specific details of the embodiments shown or described. Stated another way, the embodiments specifically shown and described are not meant to limit or restrict the scope of the appended claims.

I claim:

1. A method for making a plurality of bends in a conduit using a mechanical bending device, the method comprising:

receiving a desired offset;

receiving an actual degree;

automatically determining a distance value as a trigonometric function of the desired offset and the actual degree, wherein the distance value comprises a desired relationship between first and second bend positions;

outputting the distance value; and bending the conduit using the distance value.

2. The method of claim 1, wherein automatically determining the distance value further includes determining the second bend position.

3. The method of claim 1, wherein automatically determining the distance value further includes using a reference position to determine the second bend position.

4. The method of claim 1, wherein automatically determining the distance value further includes accessing a memory and correlating at least one of the actual degree and the offset to the distance value.

5. The method of claim 1, wherein automatically determining the distance value further includes determining a distance between respective centers of the first and second bend positions.

6. The method of claim 1, further comprising bending the conduit using the distance value.

7. The method of claim 6, wherein bending the conduit further includes repositioning the conduit while the conduit remains in the mechanical bending device.

8. The method of claim 6, wherein bending the conduit further includes making a bend at the second bend position including the actual angle.

9. The method of claim 6, wherein bending the conduit further includes using a position indicating device to bend the conduit the actual degree.

10. The method of claim 6, wherein bending the conduit further includes signaling an installer when the actual degree is achieved.

11. The method of claim 1, wherein receiving the actual degree further includes determining the actual degree.

12. The method of claim 1, wherein receiving the actual degree further includes automatically determining the actual degree.

13. The method of claim 1, wherein receiving the actual degree further includes determining the actual degree while using false zero mode.

14. The method of claim 1, further comprising removably attaching the bend determining device to at least one of the mechanical bending device and the conduit.

15. An apparatus, comprising:

a bend determining device for receiving a desired offset and an actual angle, the bend determining device having a processor configured to execute program code for automatically determining using a trigonometric function a distance value indicative of where a second bend of an offset should be on a conduit using the desired offset and the actual angle; and a display in communication with the bend determining device for outputting the distance value to an installer.

16. The apparatus of claim 15, further comprising a position indicating device configured to initiate a signal in response to contacting at least one of a mechanical bending device and the conduit.

17. The apparatus of claim 15, further comprising a mechanical bending device configured to bend the conduit.

18. The apparatus of claim 15, wherein the bend determining device automatically determines the actual angle.

19. The apparatus of claim 15, further comprising an attachment mechanism for attaching the bend determining device to at least one of a bender and the conduit.

20. The apparatus of claim 15, wherein the bend determining device further includes at least one of a: protractor, measuring device, level holder, conversion table and a position indicating device carrier.

21. The apparatus of claim 15, wherein the bend determining device determines the distance value while the conduit remains in the mechanical bending device.

22. The apparatus of claim 15, further comprising a reference position on the conduit.

23. The apparatus of claim 15, wherein the distance value equals a distance between respective centers of the first and second bend positions.

24. The apparatus of claim 15, further comprising a protractor that operates in false zero mode.

* * * * *